US007241137B2

(12) United States Patent
Leinemann et al.

(10) Patent No.: US 7,241,137 B2
(45) Date of Patent: Jul. 10, 2007

(54) FLAME ARRESTOR

(75) Inventors: Christoph Leinemann, Braunschweig (DE); Thomas Heidermann, Didderse (DE)

(73) Assignee: Leinemann GmbH & Co. KG, Braunschweig (DE)

( * ) Notice: Subject to any disclaimer, the term of this patent is extended or adjusted under 35 U.S.C. 154(b) by 148 days.

(21) Appl. No.: 10/525,075

(22) PCT Filed: Jun. 26, 2004

(86) PCT No.: PCT/DE2004/001355

§ 371 (c)(1),
(2), (4) Date: Feb. 18, 2005

(87) PCT Pub. No.: WO2005/014112

PCT Pub. Date: Feb. 17, 2005

(65) Prior Publication Data

US 2006/0008755 A1 Jan. 12, 2006

(30) Foreign Application Priority Data

Aug. 5, 2003 (DE) ..... 103 36 530

(51) Int. Cl.
*F23D 14/82* (2006.01)

(52) U.S. Cl. ..... 431/346; 60/39.11; 431/328

(58) Field of Classification Search ..... 431/346, 431/328, 7, 349, 347, 350; 48/192; 60/39.11
See application file for complete search history.

(56) References Cited

U.S. PATENT DOCUMENTS

| | | | | |
|---|---|---|---|---|
| 1,681,698 | A | 8/1928 | Brooke | |
| 3,173,411 | A * | 3/1965 | Corbin | 126/85 R |
| 4,909,730 | A * | 3/1990 | Roussakis et al. | 431/346 |
| 4,917,599 | A | 4/1990 | Hasselmann | |
| 5,346,389 | A | 9/1994 | Retallick et al. | |
| 5,588,822 | A * | 12/1996 | Hayakawa et al. | 431/1 |
| 6,179,608 | B1 * | 1/2001 | Kraemer et al. | 431/9 |
| 6,338,319 | B1 * | 1/2002 | Vago | 122/13.01 |
| 6,342,082 | B1 * | 1/2002 | Leinemann | 48/192 |
| 6,409,779 | B2 * | 6/2002 | Leinemann | 48/192 |

FOREIGN PATENT DOCUMENTS

| | | |
|---|---|---|
| DE | 693 05 351 T3 | 6/1993 |
| JP | 59136140 | 8/1984 |

* cited by examiner

*Primary Examiner*—Kenneth Rinehart
*Assistant Examiner*—Chuka C Ndubizu
(74) *Attorney, Agent, or Firm*—Whitham, Curtis, Christofferson & Cook, PC

(57) ABSTRACT

A flame arrestor for a flowing explosive gas (4), having a flame barrier (10, 20, 30) with a large number of defined passage gaps (17, 18), whose gap cross section is set with regard to the properties of the flowing gas (4), is cooled effectively and secured against a flame flashback in the case of continuous combustion by the fact that second gaps (18) having a smaller gap cross section are arranged adjacent to the first gaps (17) having the selected gap cross section.

9 Claims, 4 Drawing Sheets

Figure 7:
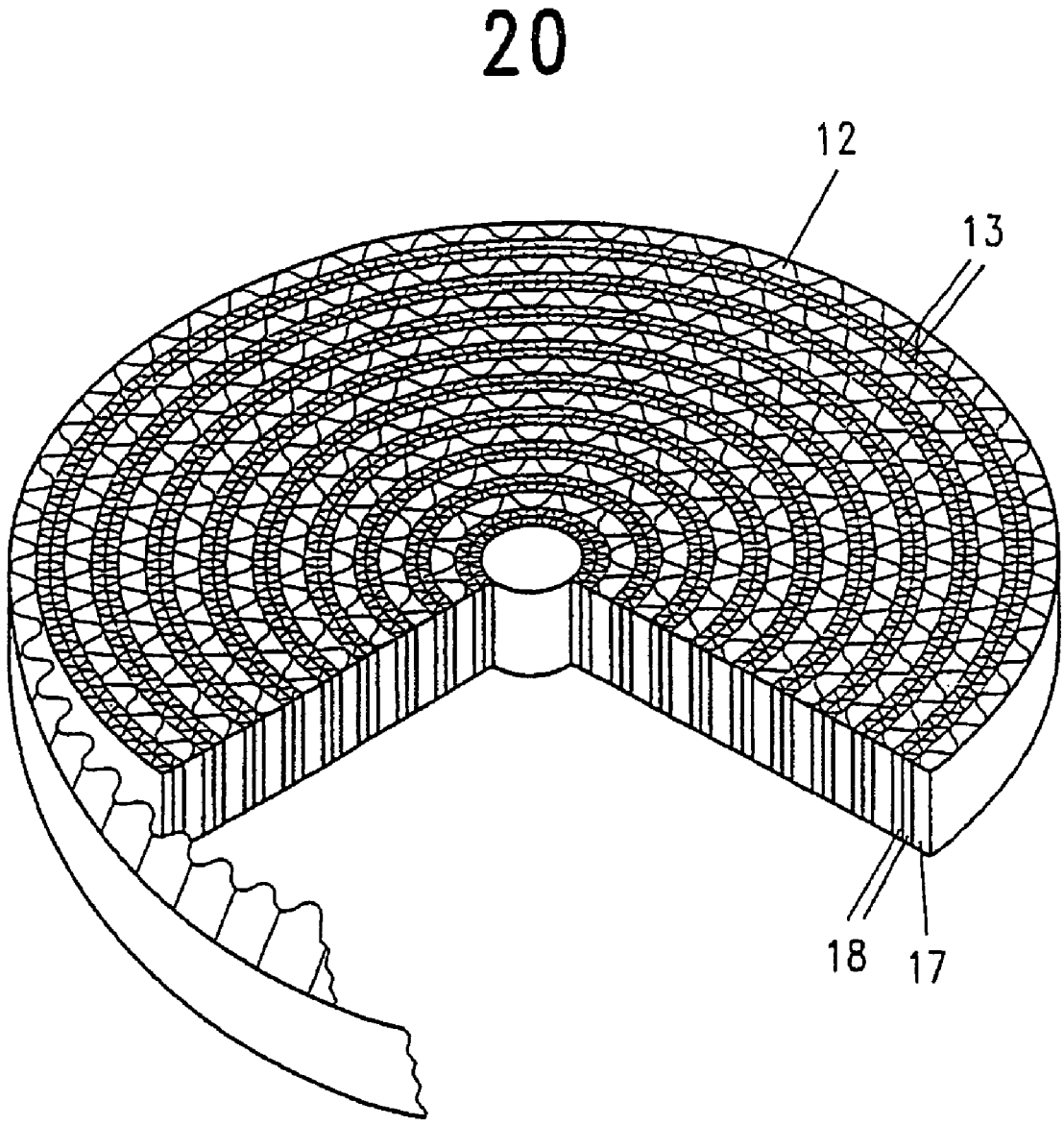

Fig. 1
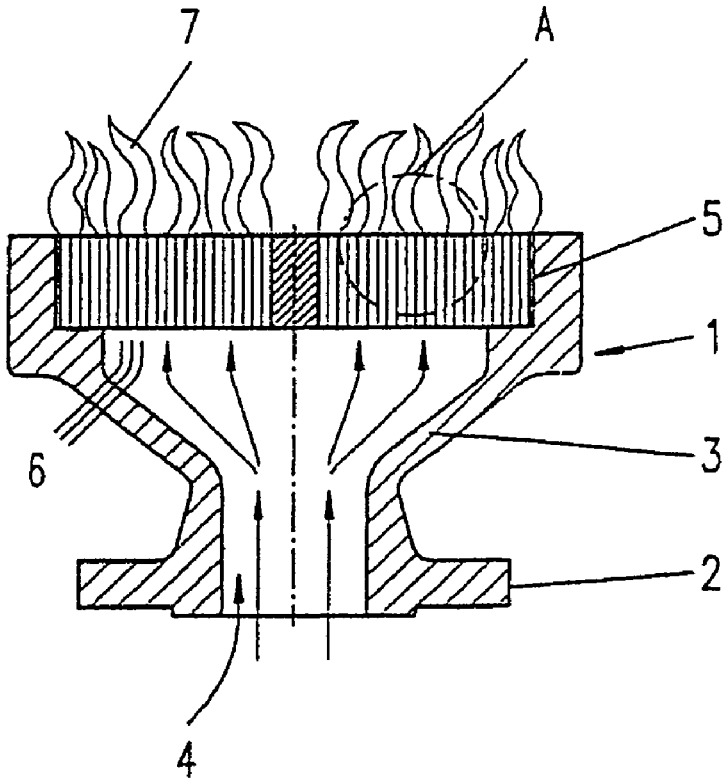
Fig. 2 Detail A
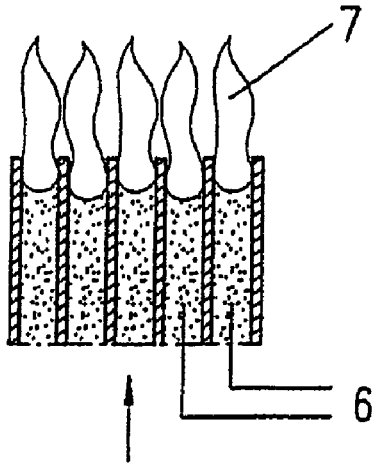

Fig. 3
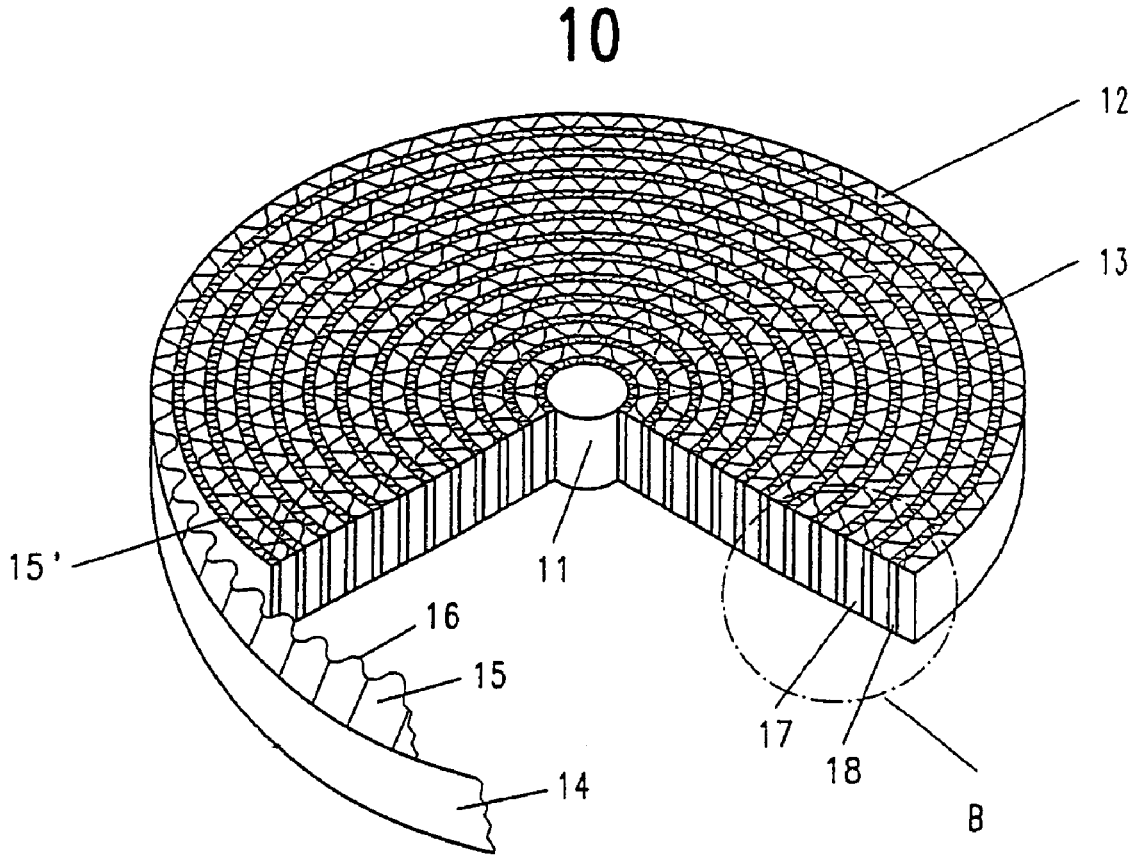
Fig. 4 Detail B
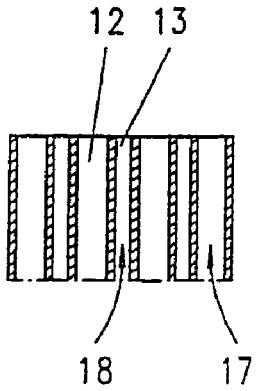
Fig. 5
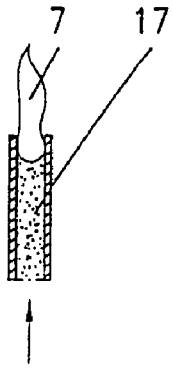
Fig. 6
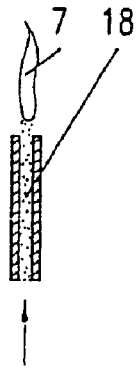

FLAME ARRESTOR

The invention relates to a flame arrestor for a flowing explosive gas, having a flame barrier with a large number of defined passage gaps, whose gap cross section is set with regard to the properties of the flowing gas.

Flame arresters of this type are used, for example, for the ventilation of plant at risk of explosion. They must be designed to be safe with respect to continuous combustion in the event of ignition of the gas or product vapor-air mixtures flowing out, that is to say it must be possible to flare off the gas/gas mixture over an unlimited time period without a flame flashback into the part of the plant to be protected occurring.

The flame arresters are based on the principle that the gas flowing through the passage gaps of the flame barrier is cooled by the wall of the passage gaps, so that the gas at the outlet of the flame barrier is cooled below its ignition temperature. In order to achieve safety with respect to continuous combustion, the material of the flame barrier which bounds the passage gaps must be cooled adequately in order that the intended cooling of the gas on the wall of the passage gaps is achieved.

The maximum heating of a flame barrier arises if the flow reaches or falls somewhat below what is known as the critical volume flow in the flame-extinguishing gaps. The critical volume flow corresponds to a flow velocity which corresponds to that of a laminar propagation velocity to be assigned in each case to every ignitable mixture. In this operating state, the gas or the gas mixtures not only flare immediately on the surface of the flame barrier but initially penetrate somewhat into the flame-extinguishing gap. Since, as a result, the wall of the flame-extinguishing gap is heated up, the flame can penetrate deeper and deeper into the flame-extinguishing gap, which means that there is a risk of flame flashback.

FIG. 1 shows a known flame arrestor, which is arranged so as to be secure against continuous combustion at the outlet of a part of a plant. It comprises a housing 1 having a flange 2 on the plant side and a conical widening 3 oriented away from the flange 2 and belonging to a flow duct 4, which is terminated at the other end of the housing 1 by a flame barrier 5. The flame barrier 5 comprises turns 6 wound in a circular or spiral shape, which are preferably produced by the combination of a smooth metal strip with a corrugated metal strip. The gap cross section is defined by the choice of the corrugation of the corrugated metal strip. The width of the metal strip determines the gap length. FIG. 1 shows that the gas flowing through the flame barrier 5 has ignited on the side facing away from the plant and forms flames 7.

The detail A illustrated in FIG. 2 shows the penetration of the flames 7 into the gaps 6 in an enlarged illustration. It is therefore necessary to ensure on the plant side that a flow velocity for the gas is always maintained which prevents the flow falling below the critical volume flow. This may be achieved in principle by the cross section of the gaps being reduced since, as a result, the volumetric velocity of the gas in the gaps is increased. However, this enlarges the flow resistance effected by the flame barrier. In order to achieve the same total free cross section, the area of the flame barrier, that is to say the conical widening 3 of the flow duct 4, must be enlarged for this purpose. This means that the flame arrestor becomes more voluminous and more expensive.

The present invention is based on the object of constructing a flame arrestor of the type mentioned at the beginning with increased safety with respect to flame flashbacks.

In order to achieve this object, according to the invention a flame arrestor of the type mentioned at the beginning is characterized in that second gaps with a smaller gap cross section are arranged adjacent to the first gaps having the selected gap cross section.

The present invention is based on the effect that, for the case in which the critical volume flow is reached for the first gaps, the flow velocity in the second, narrower gaps, is still considerably higher, so that adequate cooling by the flowing gas is in any case carried out in the narrower, second gaps. The cooler gaps are then capable of picking up and carrying away heat from the adjacent first gaps. The flow resistance of the flame barrier is increased only little overall by the narrower second gaps, so that an enlargement of the total area of the flame barrier is not required or is required only to a low extent. On account of the action described of the second gaps, a considerable improvement of the security against flame flashback of the flame barrier is achieved with a design which is otherwise unchanged.

In a preferred embodiment of the invention, the passage gaps are implemented in a disk-like flame barrier, the gaps preferably being arranged on turns formed in the shape of rings or spirals.

The arrangement of the second gaps relative to the first gaps can be carried out in a simple manner by a first number of turns having first gaps and a second number of turns having second gaps being provided alternately. In this case, it is conceivable for the first number and the second number both to be 1, so that in each case one turn having first gaps and one turn having second gaps are provided. However, for specific applications, it is also expedient, for example, to provide only each third turn with narrower second gaps, so that in each case two turns having first gaps are arranged between two turns having the second gaps.

Conversely, the approach can be to have a turn having first gaps followed in each case by two turns with second, narrower gaps.

The ratio of the number of turns having second gaps to the number of turns having first gaps can be constant over the area of the flame barrier. In the case of flat flame barriers, in particular those which have turns formed in the shape of rings or spirals, it can be particularly expedient if the ratio of the number of second gaps to the number of first gaps varies over the area of the flame barrier, in particular if the ratio of the number of second gaps to the number of first gaps decreases from the inside to the outside. This structure of the flame barrier is based on the finding that disk-like flame barriers heat up most intensely at the center of the flame barrier, so that the cooling action of the second, narrower gaps can be used to an increased extent there.

In the case of turns formed in the shape of rings or spirals, therefore, the relative number of turns having the second gaps can be greater in the center of the flame barrier than in the outer region.

The turns of the disk-like flame barrier are preferably formed by a corrugated metal strip wound spirally together with a smooth metal strip, a first corrugated metal strip having larger corrugations forming the turns having the first gaps, and a corrugated metal strip having smaller corrugations forming the turns having the second gaps.

The second gaps can all have the same gap cross section. However, it is also possible for the second gaps to have at least two different gap cross sections, that is to say for smaller gap cross sections of different magnitude to be used in conjunction with the first gaps. For fabrication reasons, however, providing only one gap cross section for the second gaps will regularly be preferred.

The implementation of the first and second gaps can also be carried out by the turns having the first and second gaps over their length, so that, over the length of the turns in each case, a first number of first gaps and a second number of second gaps are arranged alternately one after another.

In the preferred embodiment of a disk-like flame barrier which is formed by a corrugated metal strip wound spirally together with a smooth metal strip, the corrugation of the corrugated metal strip thus alternately has shorter and longer lengths of the corrugations in order to form the first and second gaps.

In the flame barriers according to the invention, the first and second gaps are preferably formed with the same gap lengths.

The cross-sectional area of the second gaps should amount at most to the size of the cross-sectional area of the first gaps, in order to achieve the effect according to the invention clearly enough. The selection of the cross-sectional area of the second gaps, however, is naturally associated with the selected number of the second gaps relative to the number of the first gaps. From this, those skilled in the art are given a not inconsiderable freedom of configuration within the scope of the present invention. The ratio of the cross-sectional area of the second (narrower) gaps to the cross-sectional area of the first (wider) gaps is preferably between 25 and 50%, preferably around ⅓ to ⅔.

The invention is to be explained in more detail in the following text by using exemplary embodiments illustrated in the drawing, in which:

FIG. 1 shows a longitudinal section through a flame arrestor having a conventional flame barrier FIG. 2 shows a detail from FIG. 1 in order to illustrate the construction of the conventional flame barrier FIG. 3 shows a perspective view of a first embodiment of a flame barrier according to the invention for use in a flame arrestor according to FIG. 1

Figure 8:
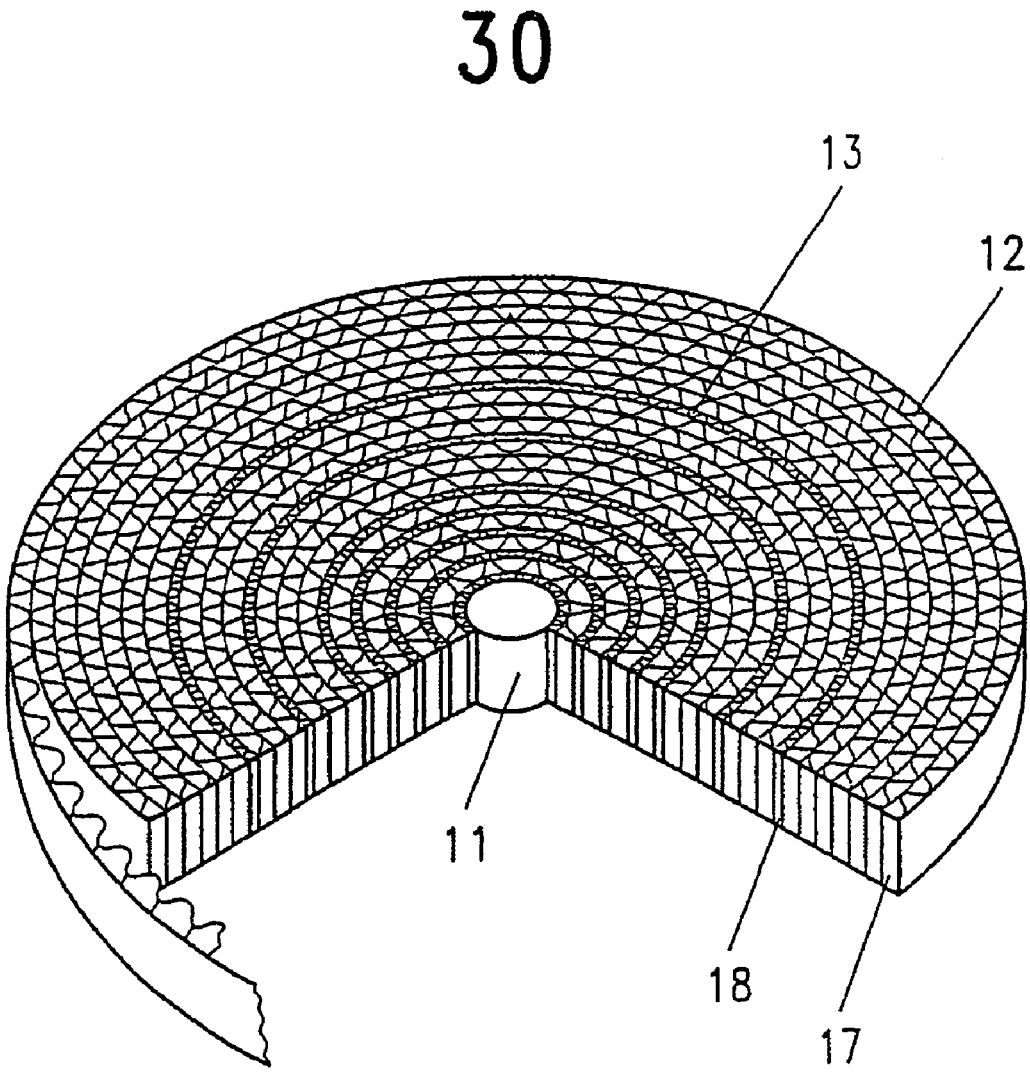

FIG. 4 shows an enlarged detail B from FIG. 3 in order to illustrate the construction of the flame barrier FIG. 5 shows a schematic illustration of a flame burning the flowing gas on the outlet side of the flame barrier in the case of a first gap FIG. 6 shows a corresponding illustration for a flame on a second gap FIG. 7 shows a perspective view of a second embodiment of a flame barrier according to the invention FIG. 8 shows a perspective view of a third embodiment of a flame barrier according to the invention.

The first embodiment of a flame barrier 10 according to the invention, illustrated in FIG. 3, comprises a cylindrical core 11, around which turns 12, 13 are wound in the form of spirals. The turns 12, 13 each consist of a smooth metal strip 14 and a corrugated metal strip 15, which are wound up together. Wound up in the turns 12 is a metal strip 15 having larger corrugations 16, while a corrugated metal strip 15' having smaller corrugations is wound up in the turns 13. Accordingly, continuous first passage gaps 17 having a larger gap cross section are formed in the turn 12 over the height of the flame barrier 10 (equal to the width of the metal strips 14, 15, 15'), and second passage gaps 18 having a smaller gap cross section are formed in the turns 12.

In the exemplary embodiment illustrated in FIG. 3 and FIG. 4, in each case a turn 12 having first gaps 17 and a turn 13 having second gaps 18 alternate.

FIGS. 5 and 6 illustrate the situation in the case of a critical volume flow for the first gaps 17 in the turn 12. Since the critical volume flow has been reached, the flame 7 is already burning within the gap 17 and thus leads to the metallic boundaries of the gap 17 heating up. By contrast, the same volume flow in the second gaps 18 leads to a higher gas velocity, so that the flame 7 burns outside the second gap 18, so that the metallic boundaries of the gap 18 remain well cooled. Since the boundaries of the gaps 18 are in direct or indirect metallic contact with the boundaries of the gaps 17, dissipation of the heat from the hotter gaps 17 to the cooler gaps 18 takes place, so that effective cooling of the first gaps 17 is carried out by the second gaps 18.

In the exemplary embodiment of a flame barrier 20, illustrated in FIG. 7, in each case two turns 13 having second gaps 18 are arranged between two turns 12 having first gaps 17. This arrangement leads to more intensive cooling of the boundaries of the first gaps 17 of the turns 12.

In the further exemplary embodiment of a flame barrier 30, illustrated in FIG. 8, considerably more turns 12 having first gaps 17 are provided than turns 13 having second gaps 18. However, the frequency of the turns 13 having second gaps 18 increases toward the core 11 of the flame barrier. For example, in each case one turn 12 is arranged beside a turn 13 in the core region of the flame barrier 30. After approximately one third of the radius, in each case three turns 12 and one turn 13 follow, while in the outer region of the flame barrier 30 only turns 12 are provided.

With this design, account is taken of the fact that disk-like flame barriers 30 regularly heat up more intensely in the core than in the outer region. Account is taken of this by the intensified arrangement of the turns 13 in the inner region relative to the turns 12, in order to effect improved cooling in the inner region of the flame barrier 30.

It is clear to those skilled in the art that numerous modifications to the exemplary embodiments illustrated are possible within the claimed invention. In all cases, improved cooling of the flame barriers 10, 20, 30 is effected without seriously increasing the flow resistance and therefore the cross-sectional area needed for the flame barrier 10, 20, 30.

The invention claimed is:

1. A flame arrestor for a flowing explosive gas, having a disk structure with a front face and a back face, the disk structure comprising:

structure forming multiple concentric rings of first gas passages, about a longitudinal axis in a flow direction, extending from the front face to the back face, said first gas passages each having a cross-sectional area, normal to the flow direction, larger than a given value; and structure forming at least one ring of second gas passages, said ring being substantially concentric with said multiple concentric rings of first gas passages, said second gas passages extending in the flow direction and each having a cross-sectional area, normal to the flow direction, less than the given value, wherein said multiple concentric rings of first gas passages and said at least one ring of second gas passages are arranged in an alternating pattern, such that said at least one ring of said second gas passages surrounds at least one ring of said first gas passages.

2. The flame arrestor of claim 1, wherein said structure forming at least one ring of second gas passages forms multiple concentric rings of said second gas passages, and wherein said multiple concentric rings of first gas passages and said multiple concentric rings of second gas passages are arranged in an alternating pattern of each of said concentric rings of first gas passages being between and concentric with rings of said second gas passages.

3. The flame arrestor of claim 1, wherein the structure forming said multiple concentric rings of first gas passages includes a first corrugated metal strip wound spirally with a smooth metal strip, and the structure forming said at least one ring of second gas passages includes a second corrugated metal strip wound spirally with a smooth metal strip, the first corrugated metal strip having larger corrugations than the second corrugated metal strip.

4. The flame arrestor of claim 1, wherein said structure forming at least one ring of second gas passages forms multiple concentric rings of said second gas passages, and wherein the ratio of the number of rings of said second gas passages to the number of rings of said first gas passages varies over the area of the flame barrier.

5. The flame arrestor of claim 4, wherein the ratio of the number of rings of said second gas passages to the number of rings of said first gas passages decreases along the radial distance from said longitudinal axis.

6. The flame arrestor of claim 1, characterized in that the second gas passages gaps all have the same gap cross sections.

7. The flame arrestor of claim 1, wherein at least one of the second gas passages has a cross sectional area different from a cross sectional area of another of said second gas passages.

8. The flame arrestor of claim 1, wherein the first and second gaps are formed with the same gap lengths.

9. The flame arrestor of claim 1, characterized in that the cross-sectional area of the second gas passages is not greater than 50% of the cross-sectional area of the first gas passages.

* * * * *